US009505534B2

(12) United States Patent
Mercado et al.

(10) Patent No.: US 9,505,534 B2
(45) Date of Patent: Nov. 29, 2016

(54) RESEALABLE CONTAINER WITH COLLAR AND LID

(71) Applicant: Mead Johnson Nutrition Company, Glenview, IL (US)

(72) Inventors: Grace Mercado, Singapore (SG); Patrick McCallister, Newburgh, IN (US); Prasad Ventrapragada, Newburgh, IN (US); Simon Tan, Singapore (SG); Sundaramurthy Dandapani, Singapore (SG)

(73) Assignee: Mead Johnson Nutrition (Asia Pacific) Pte. Ltd., Singapore (SG)

( * ) Notice: Subject to any disclaimer, the term of this patent is extended or adjusted under 35 U.S.C. 154(b) by 362 days.

(21) Appl. No.: 14/166,255

(22) Filed: Jan. 28, 2014

(65) Prior Publication Data

US 2015/0210450 A1 Jul. 30, 2015

(51) Int. Cl.

| | |
|---|---|
| ***B65D 51/20*** | (2006.01) |
| ***B65D 51/22*** | (2006.01) |
| ***B65D 43/16*** | (2006.01) |
| ***B65D 43/22*** | (2006.01) |
| ***B65D 51/24*** | (2006.01) |
| ***B65D 51/32*** | (2006.01) |
| *B65D 41/48* | (2006.01) |

(52) U.S. Cl.

CPC ..... *B65D 51/228* (2013.01); *B65D 43/163* (2013.01); *B65D 43/22* (2013.01); *B65D 51/246* (2013.01); *B65D 51/32* (2013.01)

(58) Field of Classification Search

CPC ..... B65D 2251/0062; B65D 51/20; B65D 51/228; B65D 51/246; B65D 51/32; B65D 43/22; B65D 43/0212; B65D 43/163; B65D 41/16; B65D 41/165; B65D 41/20; B65D 41/465; B65D 45/025; B65D 45/20

USPC ..... 220/258.1, 258.2, 254.3, 786, 788, 324

See application file for complete search history.

(56) References Cited

U.S. PATENT DOCUMENTS

| | | | |
|---|---|---|---|
| 5,657,894 | A | 8/1997 | Bowen |
| 5,910,188 | A | 6/1999 | Resnick |
| 6,761,279 | B1 | 7/2004 | Martin et al. |
| 6,761,283 | B1 | 7/2004 | Gilliam et al. |
| 6,772,904 | B1 | 8/2004 | Gilliam et al. |
| D504,318 | S | 4/2005 | Lane et al. |
| D553,988 | S | 10/2007 | Perry et al. |
| D576,035 | S | 9/2008 | Perry et al. |

(Continued)

FOREIGN PATENT DOCUMENTS

| | | |
|---|---|---|
| EP | 0773172 | 5/1997 |
| WO | 2010141841 | 12/2010 |

(Continued)

*Primary Examiner* — J. Gregory Pickett
*Assistant Examiner* — Niki M Eloshway
(74) *Attorney, Agent, or Firm* — Patterson Intellectual Property Law, P.C.; James R. Cartiglia; Bethany J. Whelan

(57) ABSTRACT

The present disclosure relates to a container for holding a granular product or powdered material, such as infant formula. More specifically the disclosure is directed to a container including a closure having a collar and lid for resealably securing the open end of the container. The container may include a tub having at least one collar mating protrusion and a collar having an aperture designed to engage the at least one collar mating protrusion of the tub to secure the collar to the tub. The collar may further include a lid.

17 Claims, 15 Drawing Sheets

(56) References Cited

U.S. PATENT DOCUMENTS

| | | | | |
|---|---|---|---|---|
| 7,661,528 | B2 | 2/2010 | Vovan et al. | |
| 7,694,845 | B2 | 4/2010 | Tilton | |
| D624,406 | S | 9/2010 | Cronican et al. | |
| D646,966 | S | 10/2011 | Gill et al. | |
| D661,588 | S | 6/2012 | Irani et al. | |
| 8,365,955 | B2 * | 2/2013 | Bosshardt | B65D 35/10 215/235 |
| 8,511,499 | B2 * | 8/2013 | Perry | B65D 17/502 220/254.3 |
| 8,839,975 | B2 * | 9/2014 | Luburic | B65D 25/32 220/254.3 |
| 2004/0094551 | A1 * | 5/2004 | Mavin | B29C 66/73115 220/258.2 |
| 2004/0238553 | A1 | 12/2004 | Lane et al. | |
| 2005/0035125 | A1 * | 2/2005 | Bae | B65D 43/0218 220/326 |
| 2005/0242095 | A1 * | 11/2005 | Serrano | B65D 55/16 220/254.3 |
| 2006/0249522 | A1 * | 11/2006 | Ringo | B65D 25/22 220/784 |
| 2008/0041861 | A1 | 2/2008 | Crawford et al. | |
| 2008/0073367 | A1 * | 3/2008 | Chuang | B65D 43/0218 220/786 |
| 2008/0156808 | A1 | 7/2008 | Perry et al. | |
| 2010/0108670 | A1 | 5/2010 | Perry et al. | |
| 2010/0236966 | A1 | 9/2010 | Luttik et al. | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0186570 | A1 | 8/2011 | Perry et al. | |
| 2011/0192847 | A1 | 8/2011 | Vandamme | |
| 2012/0000925 | A1 | 1/2012 | Dols | |
| 2012/0061413 | A1 | 3/2012 | Dols | |
| 2013/0081364 | A1 * | 4/2013 | Piscopo | B65B 69/00 53/492 |
| 2014/0027458 | A1 * | 1/2014 | Liu | B65D 43/164 220/270 |
| 2015/0017289 | A1 * | 1/2015 | Greenberg | B65D 43/0231 426/115 |
| 2015/0210444 | A1 * | 7/2015 | Mercado | B65D 43/22 220/212 |
| 2015/0239631 | A1 * | 8/2015 | Kinskey | B65D 81/02 220/4.22 |

FOREIGN PATENT DOCUMENTS

| | | |
|---|---|---|
| WO | 2011127133 | 10/2011 |
| WO | 2012047891 | 4/2012 |
| WO | 2012085783 | 6/2012 |
| WO | 2013163583 | 10/2013 |

* cited by examiner

RESEALABLE CONTAINER WITH COLLAR AND LID

TECHNICAL FIELD

The present disclosure relates to a container for holding a granular product or powdered material, such as infant formula. More specifically the disclosure is directed to a container including a closure having a collar and lid for resealably securing the open end of the container.

BACKGROUND

There are many products in granular or powdered form that are currently packaged in containers. These products include, but are not limited to, infant formula, flour, coffee, sugar, and nutritional supplements, for example protein supplements. Since many of these products are stored, shipped, sold and dispensed from the same container, the container should be designed to withstand the rigors to which it will be exposed, but must be user friendly for the consumer.

Plastic containers are sometimes used to store and transport various granular materials, especially in the industrial and food sectors. Some of these containers may include a lid such that the container can be opened and closed. However, depending on the particle size of the granular product, the product may leak from the plastic container, especially in and around the area where the lid seals the container. Accordingly, while many plastic containers include resealable lids so that users may open the container multiple times to extract product from the interior of the container, often times, these resealable lids are not securely attached to the tub of the container such that the granular product does not leak from the container.

Moreover, many containers that include a resealable closure often do not provide complete closure of the container. For example, some containers known in the art utilize a protrusion located about the neck of the container to engage an opening in the closure, which secures the closure to the tub. However, when storing particulate material, this type of closure may cause leakage of the particulate product during shipping or storage. Leakage of particulate product or entry of contaminants may be exacerbated in wide-mouth containers that hold particulate material. Additionally, many lids and other closures for plastic containers have slight gaps between the lid and the tub portion of the container, which allows for fine particles or even small insects, in the case of extreme climatic conditions such as in tropical climates, to come into contact with the contents of the container.

Further, especially in the case of food products, the primary seal of the container should be tamper evident so that the contents of the container cannot be accessed before being purchased and consumed by the user. For example, other prior art closures may be opened prior to the first opening by the user. When this occurs, the contents of the container may be contaminated, which may cause the product to be unfit for consumption by the user.

Additionally, even though securing the closure to a container via protrusions located in the neck of the container to apertures located within the closure is generally known, this type of engagement may not be secure enough to prevent rotation of the closure about the neck of the container. Thus, when the closure rotates and/or shifts about the opening of the container, the particulate material may leak from the container.

Accordingly, there exists a need for a closure that more completely seals to the container in order to prevent the contents of the container from leaking or to prevent insects and other contaminants from affecting the contents of the container. Additionally, there exists a need for a closure that does not rotate about the opening of the container and that remains tamper evident prior to the first opening of the tub.

As such, the present disclosure provides a container having a tub and a closure comprising a lid and collar assembly, wherein the collar is securely attached to the tub such that the contents of the tub will not leak and further, such that the collar cannot be removed without indication to the user that it has been removed. Additionally the collar and lid form several sealing areas when the lid is securely closed and after the primary seal has been removed by the consumer thereby reducing the likelihood of external contaminants from accessing the tub. Moreover, the container of the present disclosure includes a closure comprising a collar and a lid and at least one anti-rotation element that resealably closes the container such that the product in the container does not leak between and/or during multiple uses and/or openings of the container and such that the collar and lid does not rotate about the opening of the tub.

BRIEF SUMMARY

In some embodiments herein, an improved container is provided. This container generally comprises a tub having an interior portion formed by a base and at least one wall. More particularly, the container may comprise a tub, an interior portion formed by a base, a front wall, a rear wall, and opposing side walls. In some embodiments the container includes a closure adapted to be releasably sealed on the tub, wherein the closure includes a collar and a lid.

The tub may, in some embodiments, include an anti-rotation element, which prevents the collar from slipping and/or rotating around about the perimeter of the tub and therefore adds stability to the seal between the collar and the tub. The collar may also include an anti-rotation engagement element that engages the anti-rotation element located on the tub, therefore preventing the collar from slipping around the perimeter of the tub, and providing further structural stability to the tub, collar and lid assembly. Additionally, since the anti-rotation element stabilizes the collar to which the lid is attached, the lid remains in proper place on the tub even when the lid is opened and resealably closed multiple times by the user.

In some embodiments, the collar includes an inner wall having apertures therein designed to engage one or more collar mating protrusions extending from and located around the neck of the tub. The collar mating protrusions on the tub may be generally complementary in shape and size to the apertures located on the inner wall of the collar. In some embodiments, the inner wall of the collar is designed to flex toward the outer wall of the collar such that the collar can be snap-fitted onto the tub.

In some embodiments, the tub includes a circumferential channel defined by the walls and base of the tub with the channel being adapted to receive a scoop so that the contents of the container can be removed. In some embodiments, the container comprises a scoop having a handle coupled to a cylindrical bowl. The radius of the cylindrical bowl may be substantially equal to the radius of the container channel so that the bowl can be received by the channel and allow for scooping of the container contents.

DETAILED DESCRIPTION

Figure 1:
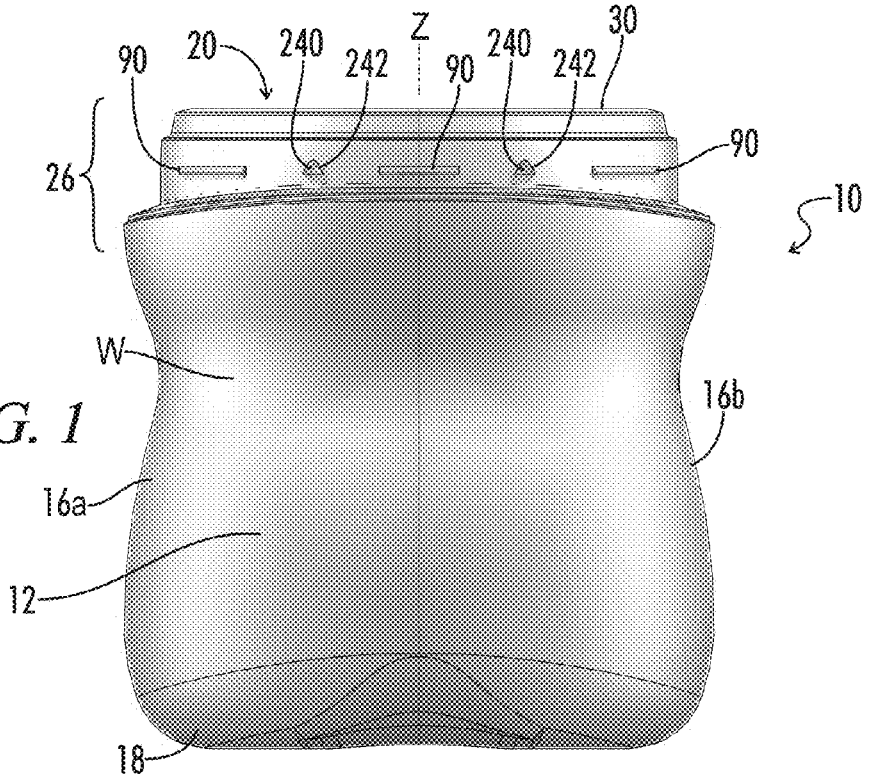
FIG. 1 shows a front view of the tub.

Reference now will be made in detail to the embodiments of the present disclosure, one or more examples of which are set forth hereinbelow. Each example is provided by way of explanation of the container of the present disclosure and is not a limitation. In fact, it will be apparent to those skilled in the art that various modifications and variations can be made to the teachings of the present disclosure without departing from the scope of the disclosure. For instance, features illustrated or described as part of one embodiment, can be used with another embodiment to yield a still further embodiment.

Thus, it is intended that the present disclosure covers such modifications and variations as come within the scope of the appended claims and their equivalents. Other objects, features and aspects of the present disclosure are disclosed in or are apparent from the following detailed description. It is to be understood by one of ordinary skill in the art that the present discussion is a description of exemplary embodiments only and is not intended as limiting the broader aspects of the present disclosure.

For the sake of clarity, not all reference numerals are necessarily present in each drawing. In addition, positional terms such as "upper," "lower," "side," "top," "bottom," "vertical," "horizontal," etc. refer to the container when in the orientation shown in the drawing. The skilled artisan will recognize that containers can assume different orientations when in use.

Figure 2:
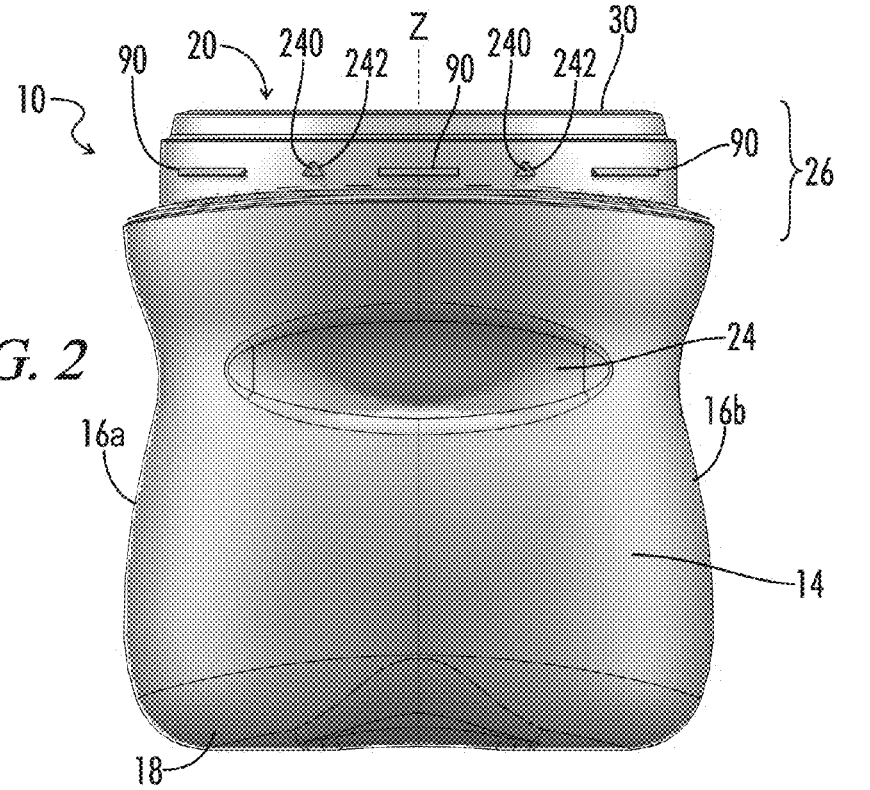
FIG. 2 shows a rear view of the tub.

Referring now to FIGS. 1-2, in some embodiments, the tub 10 is open on one side opposite its bottom or base 18 and may be of any suitable shape know in the art, including but not limited to, cylindrical, tapering, parallelepiped shaped, and waisted. An annular side wall W of the tub 10 extends about a vertical central axis Z defining an opening flange 30. The opening flange 30 defines the opening 20 of the tub 10. The opening flange 30 may be on a shallow slop descending away from the opening 20 as can be seen in the non-restrictive examples show in FIG. 1 and FIG. 5, or may be in a horizontal plane coinciding with the plane of the opening 20.

Figure 3:
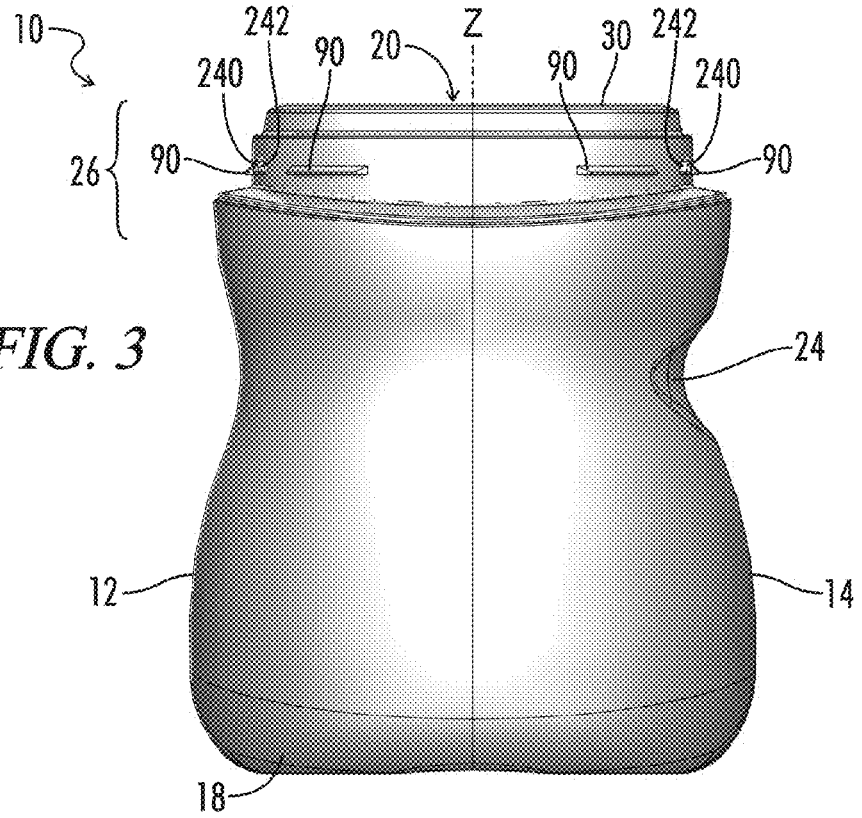
FIG. 3 shows a side view of the tub.

In some embodiments, the cross section perpendicular to the central axis Z of the tub 10 may be basically rectangular with rounded corners. For example, as shown in FIGS. 1, 2 and 3, this section various somewhat along the central axis Z to form a waist for easier gripping of the container, but these variations may be limited to ensure the vertical strength of the container is retained when stacked.

Without implying any restriction, the tub 10 may be made as a single thermally blow-molded plastic component. In some embodiments, the plastic component comprises a highly effective oxygen barrier that is suitable for use with a granulated product, such as powdered milk. In some embodiments, however, the tub 10 could comprise some other material such as metal, paperboard, or a multilayer cartonboard.

In some embodiments, the container may include a base 18 and at least one side wall. In an embodiment, referring to FIGS. 1-2, the container 10 includes a front wall 12, rear wall 14, first side wall 16*a* and second side wall 16*b*. The lower portion of the front wall 12, rear wall 14, first and second side walls 16*a* and 16*b* are coupled to a base 18. Generally, the base 18 forms the bottom of the container. The inner surfaces of the front wall 12, rear wall 14, first side wall 16*a*, second side wall 16*b* and base 18 form the interior space 22 of the tub where granular product may be stored. See. FIGS. 1-4. Further, the granular product may be placed in the tub 10 and removed from the tub 10 through the opening 20.

In some embodiments, the upper portion of the tub 10 refers to the top half or the top 50% of the front wall 12, rear wall 14, first side wall 16*a*, and second side wall 16*b*. In some embodiments, the upper portion of the tub 10 refers to the top quarter or the top 25% of the front wall 12, rear wall 14, first side wall 16*a*, and second side wall 16*b*. In still some embodiments, the upper portion of the tub refers to the top 10% of the front wall 12, rear wall 14, first side wall 16*a*, and second side wall 16*b*. Generally, the upper portion of the tub 10 refers to the portion of the side wall W or, in embodiments, the front wall 12, rear wall 14, and side walls 16*a* and 16*b* side walls, which are positioned nearer the opening 20 of the tub 10 and not the base 18 of the tub.

In some embodiments, the upper portion of the front wall 12, rear wall 14, first side wall 16*a* and second side wall 16*b* of the tub 10 may comprise a neck 26. The neck 26 of the tub 10 comprises the area of the front wall 12, rear wall 14, first side wall 16*a*, and second side wall 16*b* where closure, lid and/or collar attachment may be secured to the tub 10.

In some embodiments, the rear wall 14 comprises a grip recess 24 approximately midway up the rear wall 14 of the container. This grip recess 24 may be configured to facilitate the user's hand for gripping and picking up the container. The grip recess 24 may, in some embodiments, be oval and/or oblong in shape. See FIGS. 2-3. The grip recess 24 may also comprise a variety of shapes including, but not limited to circular, ellipsoidal, elliptical and/or rectangular. In still some embodiments, the grip recess 24 may be positioned such that the user may grip and open the lid 50 of the container with one hand. FIG. 2 displays a rear view of the container illustrating the rear wall 14 having a grip recess 24 thereon. Additionally, FIG. 3 shows a side view of the container further illustrating the grip recess 24 located in the rear wall 14.

Additionally, as shown in FIGS. 1-2, the tub may include a collar mating protrusion 90. In some embodiments, the tub 10 may comprise an anti-rotation element 240. Generally, the anti-rotation element 240 engages and/or contacts at least one surface of the collar 40 thereby preventing the collar 40 from rotating around the upper perimeter of the tub 10 or sliding around the neck 26 of the tub 10. In some embodiments, the anti-rotation element 240 engages at least one surface of the inner sealing wall 86 of the collar 40.

In some embodiments the anti-rotation element 240 comprises an outward projection located on the upper portion of the tub 10 situated at a location on the neck 26 of the tub 10 where the collar 40 fits on the tub 10. In some embodiments, the tub 10 comprises a plurality of anti-rotation elements 240. For example, the tub 10 may comprise at least two anti-rotation elements 240 situated on the upper portion of the front wall 12 of the tub 10 about the neck 26 of the tub 10 and at least two anti-rotation elements 240 situated on the upper portion of the rear wall 14 about the neck 26 of the tub 10. Still in other embodiments, the tub 10 may comprise at least four anti-rotation elements 240, wherein the anti-rotation elements are located on the neck 26 portion of the tub 10 on the front wall 12, rear wall 14, first side wall 16*a* and second side wall 16*b*, respectively.

The anti-rotation elements 240 may include a variety of shapes including but not limited to triangles, circles, ovals, rectangles, and combinations thereof. Generally, the anti-rotation element 240 is designed such that it has a collar engagement surface 242 which engages a portion of the collar 40 and prevents the collar 40 from slipping around the perimeter of the tub 10.

Figure 4:
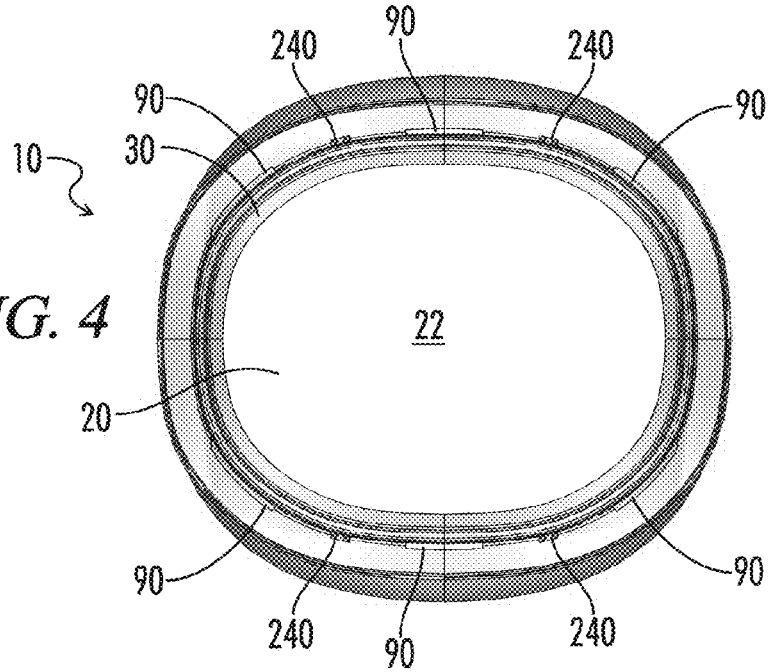
FIG. 4 shows a top view of the tub including the opening of the tub.

Referring now to FIG. 4, a top view of the tub 10 is shown. The front wall 12, rear wall 14, first side wall 16*a* and second side wall 16*b* form the interior space 22 of the tub. Further the tub 10 includes opening flange 30 which defines the perimeter of the opening 20 of the container. In some embodiments, the opening flange 30 is substantially parallel to the base 18 of the container. Still in some embodiments, the opening flange 30 may be substantially perpendicular to the neck 26 portion of the tub 10.

In some embodiments, the opening 22 of the tub 10 comprises an access ratio. In certain embodiments, the access ratio is functionally sized such that the users hand fits comfortably within the tub while still allowing the opening to be small enough to keep the overall container as a reasonable size. For example, in embodiments where an infant formula is stored in the container, the container should be sized such that it fits within a child's diaper bag without taking up too much room in the bag. Additionally, the access ratio of the opening of the tub is such that the user's hand fits comfortably within the opening, allowing the user to remove contents from the tub without the user's hand touching the opening 22 or the inner walls of the tub, thereby contaminating the contents of the container.

Figure 5:
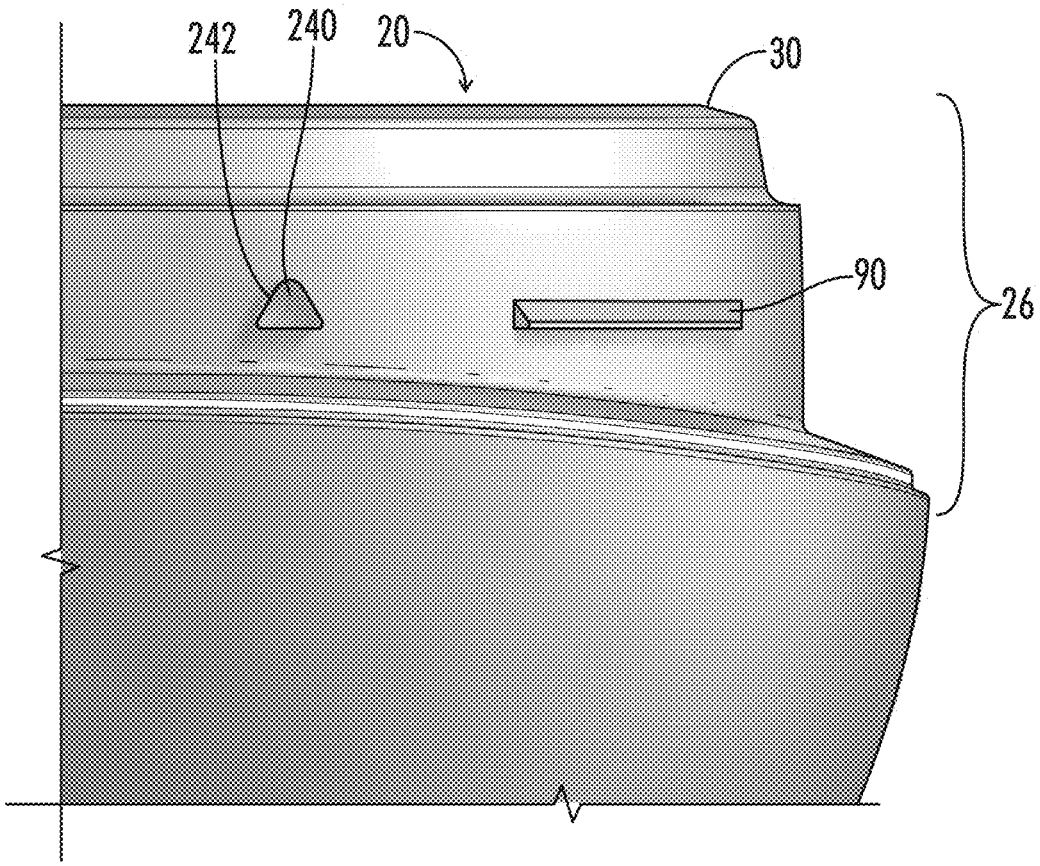
FIG. 5 shows an enlarge view of the neck of the tub including the opening flange, collar engaging protrusion, and anti-rotation element.

Referring now to FIG. 5, the tub 10 may comprise at least one collar mating protrusion 90. In some embodiments, the tub 10 comprises a plurality of collar mating protrusions 90. These collar mating protrusions 90 may be generally located on the upper portion of the tub 10. Further the collar mating protrusions 90 may be located about the neck 26 of the upper portion of the tub 10. In some embodiments, the collar mating protrusions 90 are complimentary in shape to the apertures 88 located on the inner sealing wall 86 of the collar 40. The collar mating protrusions 90 may extend outwardly from the neck 26 of the tub 10 and include a collar mating surface 92.

Figure 6:
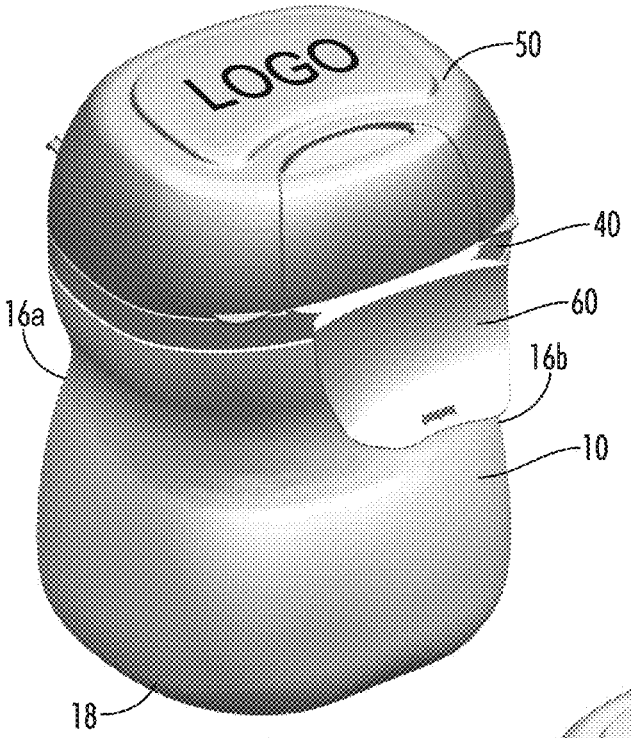
FIG. 6 shows the tub with closure attached where the lid is in closed position on the collar and the latch is not securely closed to the lid.
Figure 7:
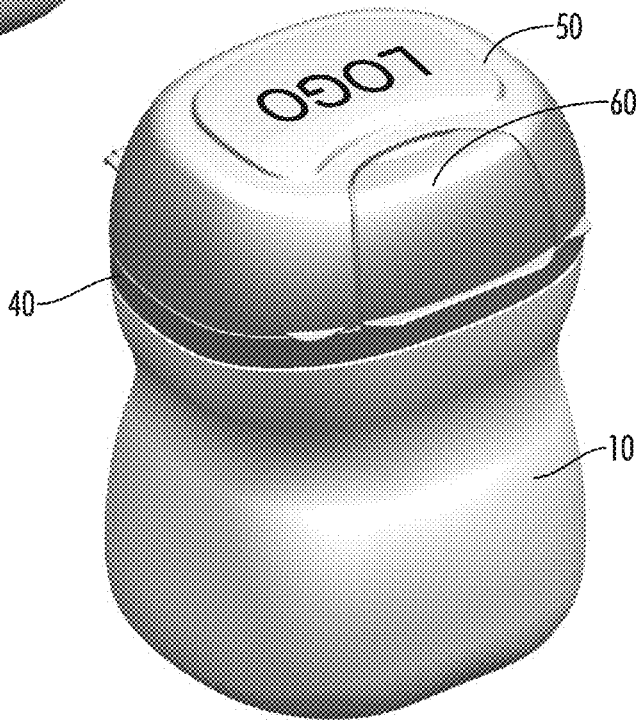
FIG. 7 illustrates the container having a tub with a collar and lid attached thereto wherein the latch is sealingly engaged in closed position with the lid.
Figure 8:
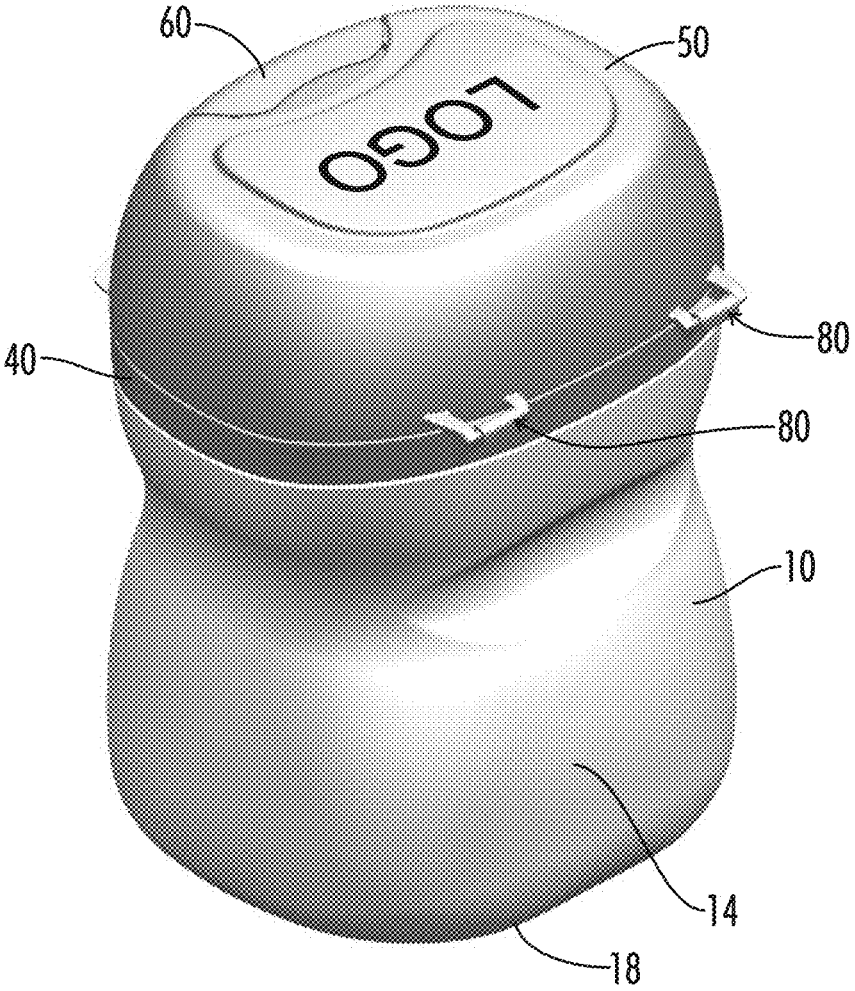
FIG. 8 shows a rear view of the container where the latch is hingedly attached to the lid.

Referring now to FIG. 6, the tub 10 may include a closure comprising a collar 40 and lid 50. In embodiments where the collar 40 comprises a latch 60, the latch 60 may be utilized to securely close the lid 50 to the tub 10. For example, in FIG. 6 the latch 60 is shown in an open position, while in FIG. 7 the latch 60 in shown in a closed position. In FIG. 7 a portion of the latch 60 is releasably secured to the top surface of the lid 50 thereby securing the lid 50 in a closed position on the tub 10. Additionally, FIG. 8 shows the latch 60 in closed position securely closing the lid 50 to the tub 10. Also shown, is the collar 40 may be hingedly attached to the lid 50 via at least one hinge 80. FIG. 8 further shows the rear wall 14, which includes a grip recess 24.

Figure 9A:
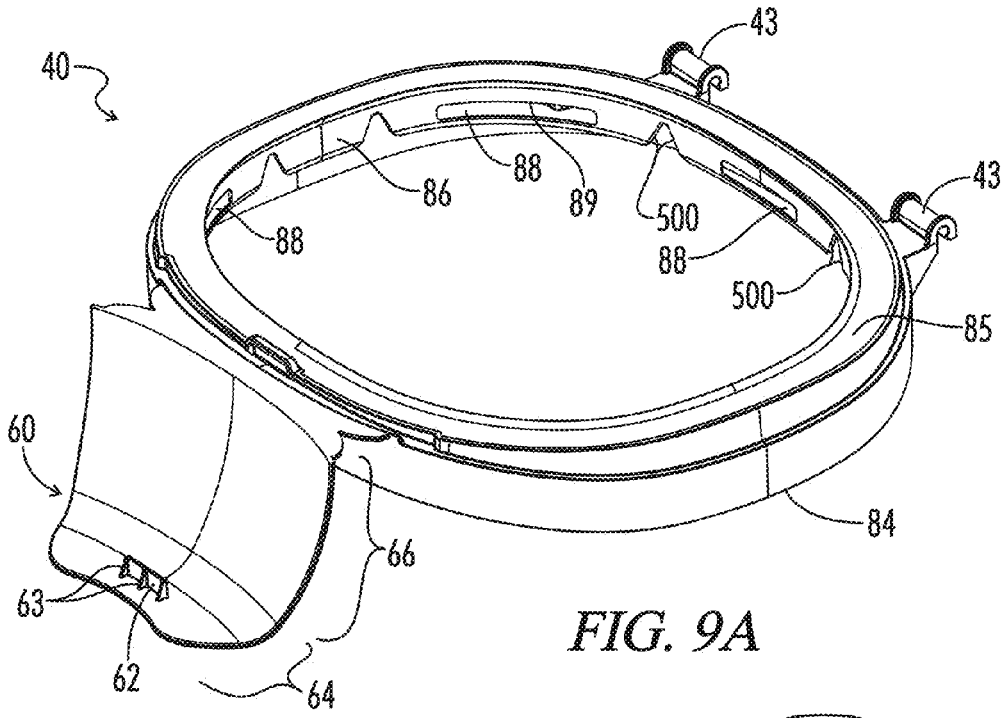
FIG. 9A shows top view of the collar including the latch.

Referring now to the collar 40, FIG. 9A shows a top view of the collar 40. In some embodiments the collar 40 comprises a latch 60. The latch 60 may be integrally molded to the collar 40. In still other embodiments, the latch 60 may be attached to the collar 40 by any suitable method known in the art. The latch 60 includes a lid engaging flange 62 that engages an aperture, opening, or other suitable structure in the lid 50 for securing the latch 60 to the lid 50. The lid engaging flange 62 may be any shape including, but not limited to, circular, ellipsoidal, rectangular or triangular. In some embodiments, the latch 60 may include a plurality of lid engaging flanges 62 to further secure the latch 60 to the lid 50 thereby further securing the lid 40 to the tub 10.

The lid engaging flange 62 may further include a strengthening rib 63. As can be seen in FIG. 9A, in some embodiments the lid engaging flange 62 may include a plurality of strengthening ribs 63. The strengthening rib(s) 63 strengthens the lid engaging flange 62 such that the lid engaging flange 62 is not damaged when it is inserted in and removed from the engagement recess 54 of the lid 50 by the user. Accordingly, the lid engaging flange 62 maintains its structural integrity to allow for multiple openings and closing of the container.

Additionally, the latch 60 includes a lid surface flange 64 that is complementary in shape to the outer top surface 52 of the lid 50. The lid surface flange 64 is designed to rest on the outer top surface 52 of the lid 50. The latch 60 may further comprise a lid sealing wall engagement surface 66, designed to engage and or rest against the outer surface of the outer sealing wall 72 of the lid 50. In some embodiments, the features of the latch 60 including the lid engaging flange 62, lid surface flange 64, and the lid sealing wall engagement surface 66, are designed to be complementary to the overall size and shape of the lid 50.

Moreover, in some embodiments the lid engaging flange 62 may be substantially perpendicular to the planar surface of the lid surface flange 64 of the latch 60. Additionally, the lid engaging flange 62 may be substantially parallel with the walls of the tub 10 when the latch 60 is in closed position. As further displayed in FIG. 9A, the lid engaging flange 62 extends from the lid surface flange 64 of the latch 60 and is designed to engage the lid 50 when the latch 60 is in closed position.

Figure 9B:
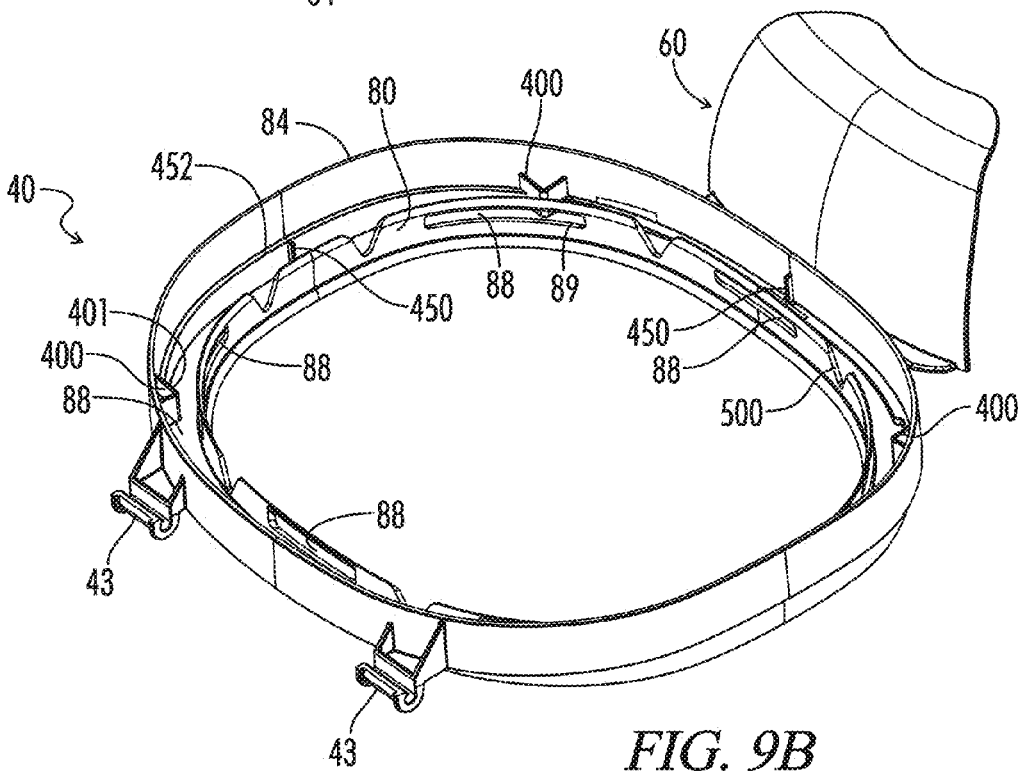
FIG. 9B provides a view of the collar displaying the interior features of the collar.

In some embodiments, the collar 40 is similar in shape to the outer surface of the neck 26 of the tub 10. For example, in embodiments where the side wall W of the tub is circular, the collar 40 include a complementary circular geometry. See. FIGS. 9A and 9B. Further, in embodiments where the side wall W of the tub 10 is rectangular, the collar 40 will be shaped in complementary rectangular fashion. More specifically, in some embodiments, the tub comprises four corner shaped areas. These corner shaped generally correspond to a corner area of the tub, however the corner areas may comprise a variety of shapes. As such, the term corner area is not meant to be limiting and merely describes an area of curvature about the opening 20 of the tub 10. The collar 40 may be complementary to the overall corner areas of the tub 10.

As shown in FIG. 9B, the collar 40 may include, in some embodiments, at least one strengthening member 400. In some embodiments the collar 40 may include a plurality of strengthening members 400. Generally, the strengthening member 400 provides strength to the outer sealing wall 84 of the collar 40, such that the collar 40 does not crumple or break during use or transport of the container.

In still some embodiments, the strengthening member 400 may include a tub engagement surface 401. More specifically, as shown in FIG. 9B, in some embodiments the strengthening members 400 may be located generally in the corner areas of the collar 40 which correspond to the corner areas of the tub 10. The strengthening members 400 may be located at a variety of locations about the inner side of the outer sealing wall 84 of the collar 40.

In some embodiments the collar 40 may comprise an outer sealing wall 84 and an inner sealing wall 86. As can be seen in FIG. 9B, in some embodiments the collar 40 includes a lateral collar wall 85, which extends laterally from the outer sealing wall 84 of the collar 40 towards the tub 10. In some embodiments, one end of the lateral sealing wall 85 attaches to the outer sealing wall 84 and the other end of the lateral sealing wall 85 attaches to the inner sealing wall 86.

In some embodiments the inner side of the outer sealing wall 84 of the collar 40 may include at least one rib 450. In some embodiments, the inner side of the outer sealing wall 84 may include a plurality of ribs 450. For example, as can be seen FIG. 9B, a rib 450 may be located about the inner side of the outer sealing wall 84 generally in the area where the latch 60 is attached to the collar 40. Placing a rib in this location of the collar 40, strengthens the collar 40 and prevents degradation, including crumpling or breaking of the collar 40, as the latch 60 is manipulated into an open and closed position multiple times by the user. As such, in some embodiments, the collar 40 may include a plurality of ribs 450, strategically placed and/or spaced about the collar 40, including the inner side of the collar 40 to prevent degradation or damage of the collar 40.

In some embodiments, the collar 40 may comprise a second wall 452 located generally about the inner side of the outer sealing wall 84. In some embodiments the second sealing wall 452 is located between the outer sealing wall 84 and the inner sealing wall 86. As shown in FIG. 9B, in some embodiments, one side of the second wall 452 engages the inner side of the outer sealing wall 84, thereby providing additional strength to the outer sealing wall 84 of the collar 40. Still, in some embodiments, the second wall 452 of the collar may include a rib 450 located on the wall surface opposite the outer sealing wall 84. In some embodiments, the second wall 452 may comprise a plurality of ribs 450 located thereon. These ribs 450 may provide additional strength to the structure of the second wall 452, thereby strengthening the not only the second wall 452 but also the outer sealing wall 84 of the container and thus, strengthening the overall structure of the collar 40.

In some embodiments, one side of the second wall 452 of the collar engages the outer sealing wall 84 of the collar 40, and at least a portion of the other side of the second wall 452 may engage the outer surface of the tub 10. This engagement between the second sealing wall 452 of the collar 40 and tub 10 may create an additional seal between the tub and the collar, thereby strengthening the connection between the tub 10 and the collar 40. This additional seal, may further prevent contaminants from entering the tub 10, and may also assist in strengthening the neck 26 of the tub 10.

In still some embodiments, the inner wall 86 of the collar 40 may include an engagement surface 500. This engagement surface 500 located on the inner wall 86 of the container is designed to engage an anti-rotation element 240 located about the neck 26 of the tub 10. See FIG. 9B. In some embodiments, the inner wall 86 of the collar 40 may include a plurality of engagement surfaces 500, each designed to engage at least one anti-rotation element 240 located on the neck 26 of the tub 10. For example, as presented in the non-limiting example shown in FIG. 9B, the engagement surface 500 of the collar 40 is triangular in shape, which corresponds to a triangular shaped anti-rotation element 240 located on the neck 26 of the tub 10. See. FIG. 9B. Accordingly, in some embodiments the shape of the engagement surface 500 of the collar is complementary to the shape of the anti-rotation element 240 located on the tub 10. Further, while a triangle shape is shown in the figures attached herein, any shape known in the art or suitable for use as an anti-rotation element and corresponding engagement surface may be used. Non-limiting examples of shapes include, triangles, circles, ovals, ellipses, rectangles, squares, and combinations and variations thereof.

Additionally, the inner sealing wall 86 of the collar 40 may include at least one aperture 88. In some embodiments, the inner sealing wall 86 of the collar 40 includes a plurality of apertures 88. The apertures 88 may be comprised of any shape suitable in the art, including but not limited to, circles, ovals, rectangles, squares, triangles, and any combination thereof. Thus, while FIG. 9B shows only oval shaped apertures 88, the inner sealing wall 86 could comprise both oval and rectangle apertures 88. For example, the inner sealing wall 86 of the collar 40 could include oval apertures that correspond to the front wall 12 and rectangle apertures that correspond to the rear wall 14 of the tub 10. Accordingly, when the collar 40 is snapped onto the tub 10, it is only possible for the apertures 88 of the collar 40 to mate with the tub 10 in one way. Generally, the apertures 88 of the inner sealing wall 86 of the collar 40 are designed to engage at least one or a plurality of collar mating protrusions 90 located on the neck 26 of the tub 10.

Figure 11:
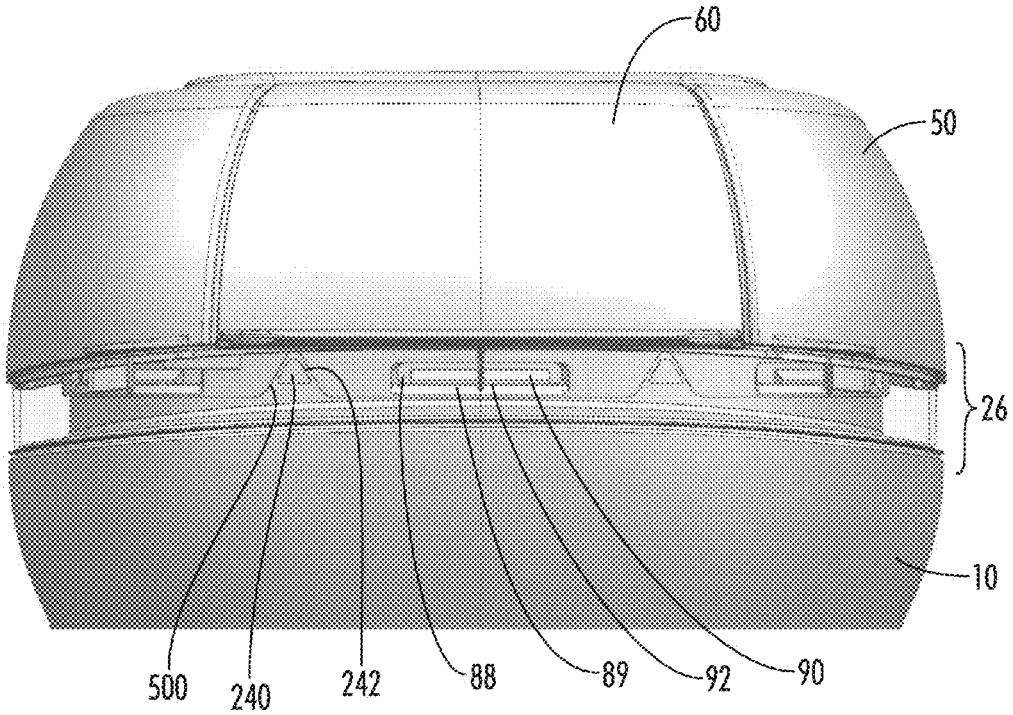
FIG. 11 displays a schematic view of the engagement connection of the collar and tub.
Figure 13:
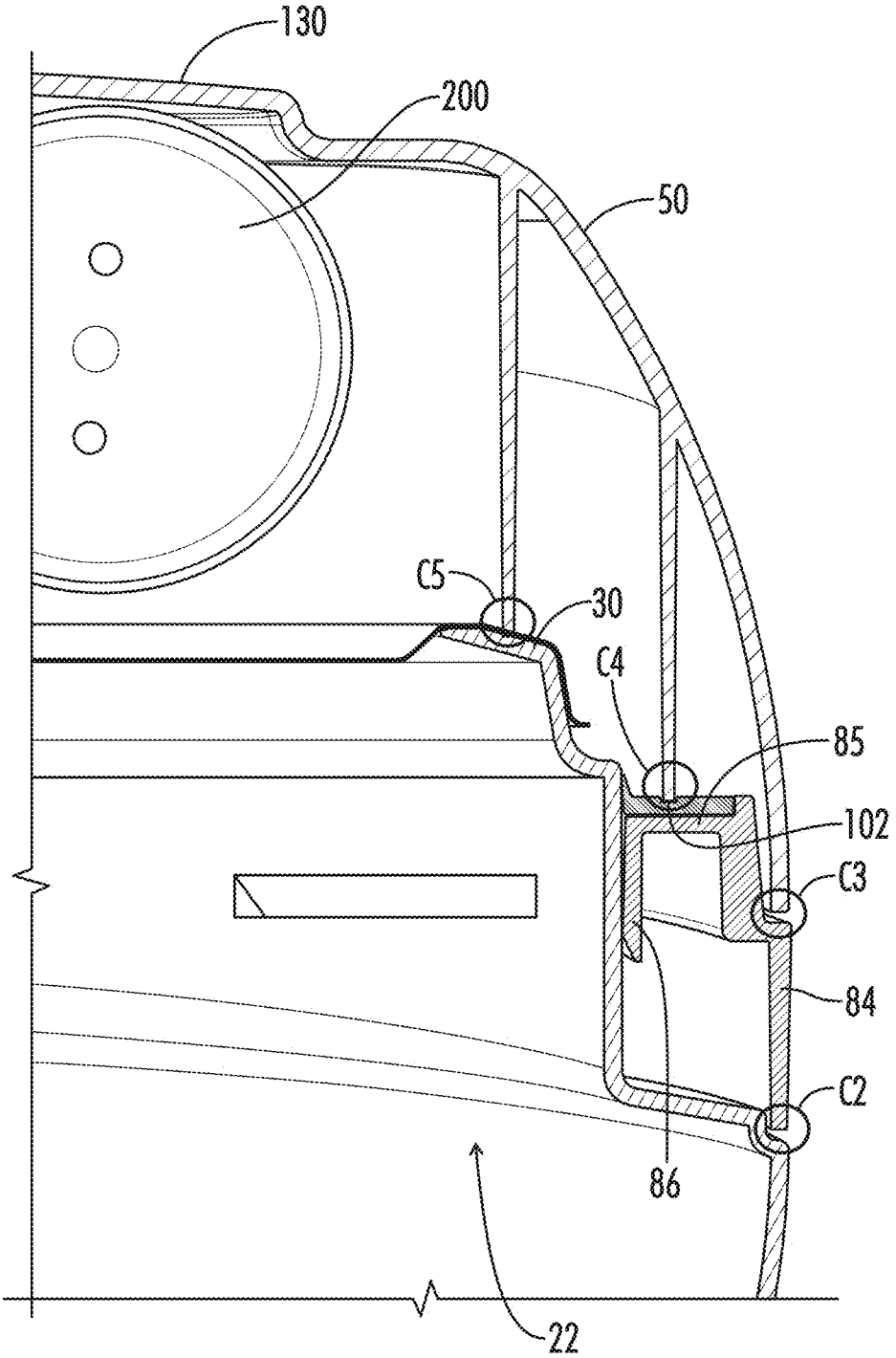
FIG. 13 shows a cross section of the tub, collar, lid, and sealable membrane displaying the engagement connections between the tub protrusion and collar aperture.

Additionally, the apertures 88 of the inner sealing wall 86 of the collar 40 may include a tub mating surface 89. In some embodiments the tub mating surface 89 of the apertures 88 may include the entire surface of the aperture 88. In other embodiments the tub mating surface 89 may comprise at least one side of the aperture 88. For example, as shown in FIGS. 11 and 13, the collar mating protrusion 90 does not engage the entire perimeter of the aperture 88.

In embodiments where there are a plurality of apertures 88 there are a plurality of tub mating surfaces 89 that provide extra structural stability to the collar 40 when it is attached to the tub 10. Furthermore, having a plurality of tub mating surfaces 89 strengthens the seal between the collar 40 and the tub 10, such that the collar 40 does not move around the neck 26 of the tub 10.

In some embodiments, the collar 40 includes at least one hinge attachment 43. In some embodiments, the collar 40 includes a plurality of hinge attachments 43. These hinge attachments 43 mate with hinge attachments, shown in FIG. 11*b* by reference FIG. 80, located on the lid 50 to hingedly attached the lid 50 and collar 40, thus creating a closure for the tub 10.

Figure 10A:
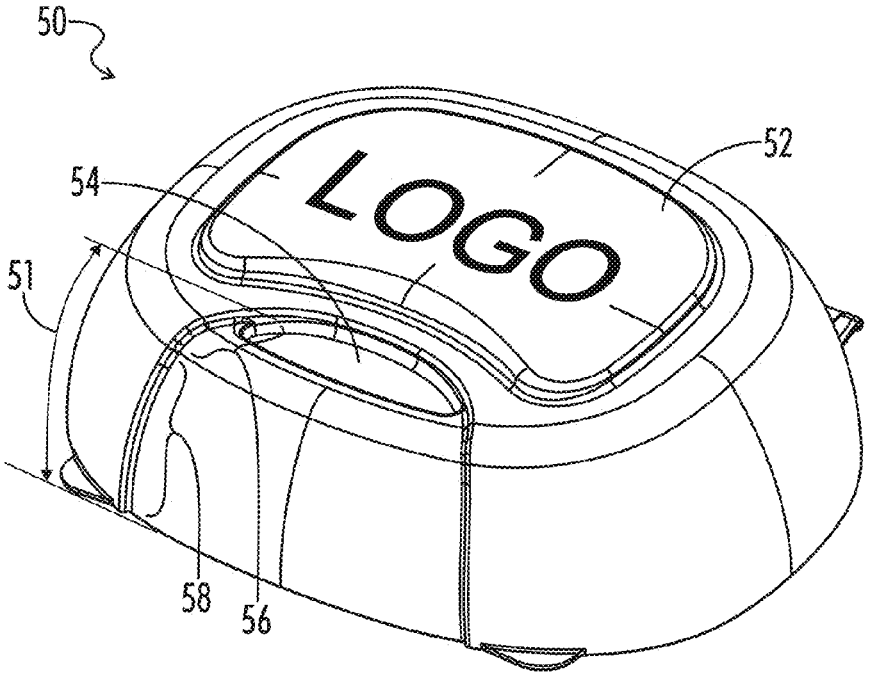
FIG. 10A shows the outer surfaces and features of the lid.
Figure 10B:
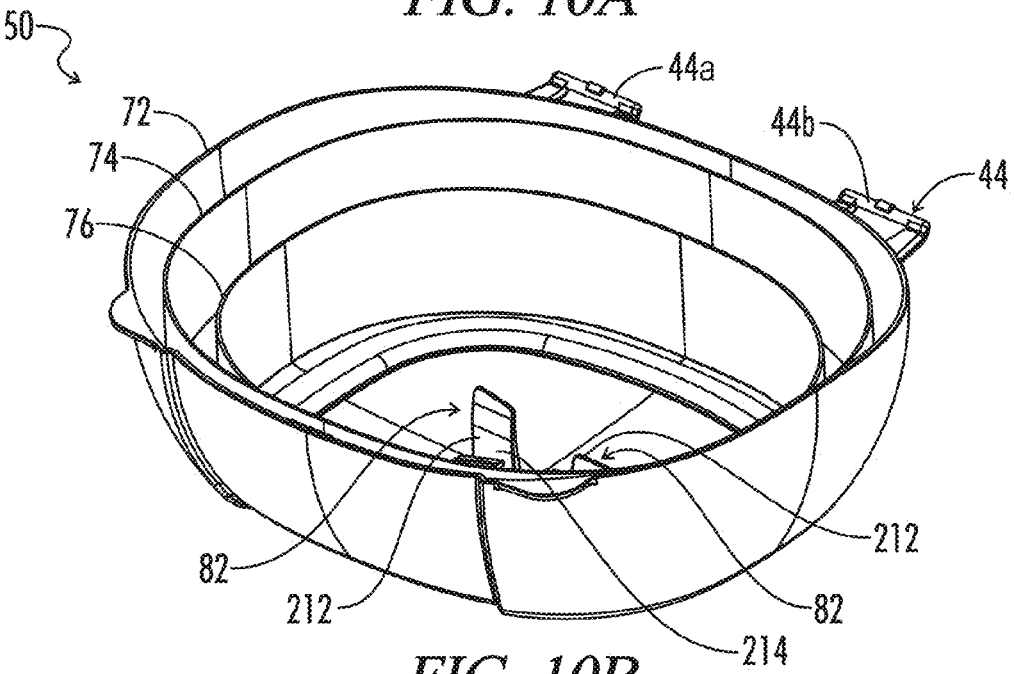
FIG. 10B shows the inner surface and features of the lid.

Referring now to FIGS. 10A and 10B, the lid 50 may include an outer top surface 52. Additionally, the lid 50 may comprise at least one lid sealing wall 72. The lid 50 may further comprise a second lid sealing wall 74. In some embodiments, the lid may comprise an inner sealing wall 76. The second lid sealing wall 74 may be located between the lid sealing wall 72 and the inner sealing wall 76. Moreover, the lid sealing wall 72 comprises an outer surface substantially parallel with the plane of the front wall 12, rear wall 14, first side wall 16*a*, and second side wall 16*b*. The upper portion of the lid sealing wall 76 contacts the outer perimeter of the outer top surface 52 of the lid 50.

Additionally, the lid 50 comprises a latch engagement portion 51. Generally the latch engagement portion 51 of the lid 50 is, in some embodiments, located on a portion of the outer surface of the lid sealing wall 72 and a portion of the outer top surface 52 of the lid 50. Generally this recess is complementary in shape and depth to the latch 60, more specifically the recess may be complementary in shape to the lid surface flange 64 and the lid sealing wall engagement surface 66 of the latch 60. The recess may include a lid surface engagement recess 56 and an outer lid sealing wall recess 58. In this manner the lid surface flange 64 of the latch 60 is complementary in shape to the lid surface engagement recess 56 and the outer lid sealing wall engagement surface 66 of the latch 60 is complementary in shape to the lid sealing wall recess 58.

The latch engagement portion 51 including the lid recess is designed to accommodate the dimensions of the latch 60, such that when the latch 60 is in closed position the latch 60 remains flush with both the outer top surface 52 and the outer surface of the lid sealing wall 72 of the lid 50. Moreover, when the latch 60 is moved into a closed position on the lid 50, the user will experience a tactile sensation when the latch 60 is securely engaged within the recess of the latch engagement portion 51 of the lid 50. This tactile sensation signals that the latch 60 is securely engaged with the lid 50 of the container.

The latch engagement portion 51 may further include an engagement recess 54 for securely engaging the lid engaging flange 62 of the latch 60 thereby securing the collar 40 and latch 60 to the lid 50 and further securely closing the lid 50 to the tub 10. In some embodiments, the lid engaging flange 62 of the latch 60, may make an audible sound, which can in certain embodiments be described as a "click", when it is inserted into the engagement recess 54 located within the latch engagement portion 51 of the lid 50. This clicking noise, which is audible to the user, indicates that the latch 60 has been secured to the lid 50, and further indicates that the lid 50 has been securely sealed to the tub 10.

The lid 50 may comprise at least one lid hinge attachment 44. See FIG. 10B. In some embodiments the lid 50 may comprise a plurality of lid hinge attachments 44*a* and 44*b*. The lid hinge attachments 44*a* and 44*b* are designed to be hingedly coupled with the collar hinge attachments 43*a* and 43*b* thereby hingedly attaching the collar 40 and the lid 50. When coupled, the lid hinge attachments 44 and the collar hinge attachments 43 comprise the hinges 80. In some embodiments, where hinged members are not desirable the collar 40 may be attached to the lid 50 by any suitable method known in the art. Nonlimiting examples for coupling the lid 50 to the collar 40 include utilizing heat, as in molding or welding the collar 40 and lid 50 together, or utilizing a suitable adhesive. In some embodiments, the collar 40 and lid 50 may be snap-fitted together. Moreover, when the lid 50 and collar 40 are hingedly attached they may be referred to generally as the closure.

As shown in FIG. 10B, the lid 50 may include a scoop attachment element 82 located on the inner top surface 78 of the lid 50. The scoop attachment element 82 may include multiple flexible tabs 212 arranged to releasably secure the scoop 200 to the inner top surface 78 of the lid 50. The flexible tabs 212 may be centrally located on the inner top surface 78 of the lid within the raised center portion 130. In some embodiments, a set of three tabs 212 are arranged to secure the handle portion 202 of the scoop 200 and a set of two tabs 212 are arranged to secure the bowl 204. Each tab 212 may contain a protrusion 214 that assists in securing scoop 200 to the lid 50 when the lid 50 is secured tub 10.

Since, in some embodiments, the collar 40 is snap-fitted onto the top of the tub 10, the inner sealing wall 86 of the collar 40, is designed to flex laterally towards the outer sealing wall 84 of the collar 40 to allow for the collar 40 to fit over the neck 26 of the tub 10. The flexibility provided by the inner sealing wall 86 allows for the collar 40 to be secured to the tub 10 without causing any breakage or damage to the structure of the collar 40 and/or tub 10. Accordingly, in some embodiments, the inner sealing wall 86 of the collar 40 provides increased resilience such that the collar 40 can be fitted over the tub 10 and snapped into place.

When the collar 40 is snapped onto the tub 10, the inner sealing wall 86 laterally flexes toward the outer sealing wall 84 of the collar 40 thereby allowing the tub mating surface 89 of the collar 40 to engage the collar mating surfaces 92 of the collar mating protrusions 90 located on the neck 26 of the tub 10. Once the collar 40 is snapped into place the inner sealing wall 86 of the collar 40 flexes laterally back towards the tub 10 thereby securing the collar 40 to the tub 10. Moreover, given that the inner sealing wall 86 laterally flexes toward the tub, this further promotes a secure engagement between the tub mating surface 89 of the collar 40 and the collar mating surface 92 of the tub 10. See. FIG. 11.

Figure 12:
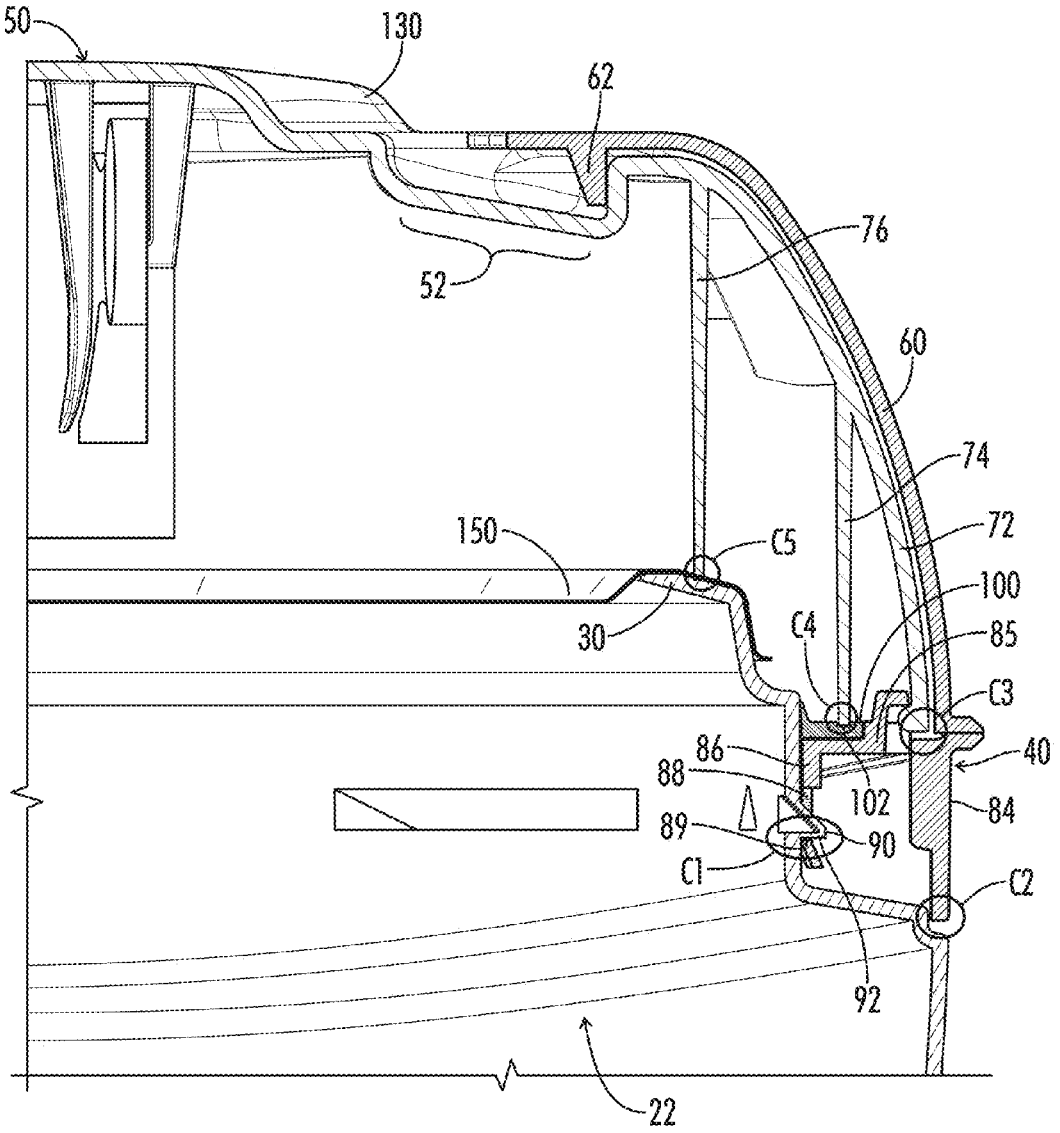
FIG. 12 shows a cross section of the tub, collar, lid and sealable membrane displaying the engagement connections between the lid walls and the tub and collar.

Referring now to FIGS. 11-12, the seal created between the tub mating surface 89 of the collar 40 and the collar mating surface 92 of the tub 10 is labeled C1. In embodiments where the tub 10 includes a plurality of collar mating surfaces 92 and the collar 40 includes a plurality of tub mating surfaces 89, a plurality of seals C1 are created, which secure the collar 40 to the tub 10. Having a plurality of seals C1 provides additional structural stability to the neck 26 of the tub 10. For example, the interlocking nature between the collar mating protrusion 90 and the aperture 88 of the collar 40 provides structural strength to both the collar 40 and the tub 10. Since, in some embodiments, the inner sealing wall 86 of the collar 40 is flush with the walls of the tub 10 when attached, the inner sealing wall 86 provides strength and support to the neck of the tub 10, such that the neck 26 is more resistant to crumpling as the lid 50 is continuously opened and closed. Moreover, additional strength is provided to the collar 40 and the tub 10, when the collar mating protrusion 90 engages the aperture 88 located on the inner sealing wall 86 of the collar 40. See FIG. 11.

Further, as shown by FIGS. 12-13, one end of the outer sealing wall 84 of the collar 40 meets the lateral collar wall 85 of the collar 40, while the other end of the outer sealing wall 84 rests on the tub 10 thereby creating sealing region C2. Sealing region C2 is a continuous seal around the entire perimeter of the tub, located between the outer sealing wall 84 of the collar 40 and the tub 10. Due to this continuous seal, sealing region C2 provides a first defense from preventing foreign contaminants from accessing the interior contents of the container thereby promoting the preservation of the sanitary nature of the contents of the container.

In some embodiments, a gasket 100 may be located on surface of the lateral collar wall 85 that faces the lid 50, when the lid 50 is in closed position. In some embodiments, the gasket 100 may cover the entire surface of the lateral collar wall 85 of the collar 40. In other embodiments, the gasket 100 may cover only a portion of the surface of the lateral collar wall 85 of the collar 40. In some embodiments, the gasket 100 is integrally molded to the collar 40. In still other embodiments, the gasket 100 is formed separately from the collar 40, and may be placed on the collar 40 prior to the collar 40 being snapped on to the tub 10. While still in other embodiments, the gasket 100 may be formed separately from the collar 40 and placed on the lateral collar wall 85 after the collar 40 has been secured to the tub 10.

The gasket 100 may be comprised of any suitable material known in the art including, but not limited to any thermoplastic elastomer ("TPE"). Non-limiting examples of suitable TPEs that may be used herein include styrenic block copolymers, polyolefin blends, elastomeric alloys, thermoplastic polyurethanes, thermoplastic copolyester, thermoplastic polyamides, and any suitable combinations and mixtures thereof.

The lid 50, when in closed position, forms a seal C3 between the outer sealing wall 84 of the collar 40 and the lid sealing wall 72. This seal C3 is a continuous annular seal about the perimeter of the collar 40 and the lid 50 and therefore prevents contaminants from entering the container. Additionally, the second lid sealing wall 74 may form a continuous annular seal C4 with one surface of the lateral collar wall 85. In some embodiments, the second lid sealing wall 74 forms a continuous annular seal C4 with the gasket 100 located on the lateral collar wall 85. In embodiments where the second lid sealing wall 74 forms a continuous annular seal C4 with the gasket 100, the gasket 100 may be designed to include a sealing groove 102 which accommodates the end of the second lid sealing wall 74 distal from the inner top surface 78 of the lid 50. In this embodiment, the second lid sealing wall 74 provides a tactile signal to the user that the lid 50 is securely closed when the distal end of the lid sealing wall 74 is securely inserted into the sealing groove 102 of the gasket 100.

Additionally, the inner sealing wall 76 of the lid 50 may, in some embodiments, create a sealing region C5 with the opening flange 30 of the tub 10. The seal C5 may form a continuous annular seal between the inner sealing wall 76 of the lid 50 and the opening flange 30 of the tub 10. The sealing region C5 provides a first defense from preventing the contents of the tub 10 from spilling out of the tub 10 and onto the gasket 100, collar 40 and/or outer surroundings.

Accordingly, in some embodiments, the container of the present disclosure is designed with at least five seals C1, C2, C3, C4 and C5, respectively. It is possible to have more than five seals depending on the number of apertures 88 and collar mating protrusions 90 that are located on the collar 40 and tub 10. The container of the present disclosure including at least five seals provides enhanced strength to the overall structure of the container. Moreover, in some embodiments four of the at least five seals, C2, C3, C4 and C5 are continuous annular seals that may further enhance the overall sealability of the container. For example, when in closed position, these seals effectively prevent foreign contaminants from entering the interior space 22 of the tub 10. Accordingly, the granular product placed in the tub 10 is kept fresh and more sanitary, as compared to granular products placed in tubs that do not comprise the at least five seals described herein.

Figure 14:
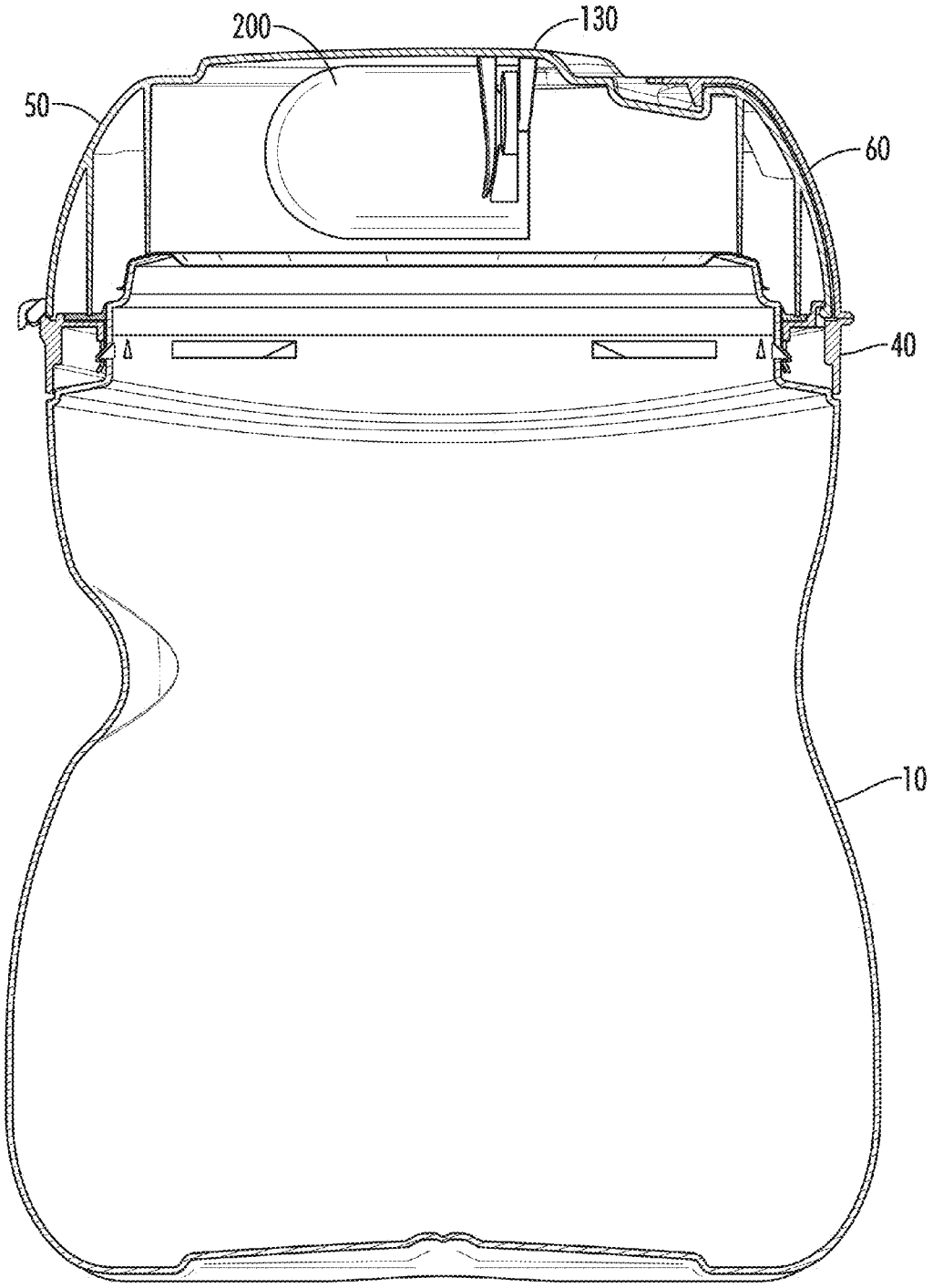
FIG. 14 shows a cross section view of the tub, collar and lid including a scooping utensil attached to the lid of the container.

FIGS. 12-14 further display the sealable membrane 150 is shown covering the opening 20 of the tub 10. The scoop 200 is shown in a fixed position in the lid 50 of the container.

As shown in FIGS. 12-14, the lid 50 of the container may further be shaped to cooperate with the features of the base 18 to enable stacking of multiple containers. For example in some embodiments, the lid 50 is shaped having a general convex surface. In some embodiments, the outer top surface 52 of the lid 50 includes a raised center portion 130. See FIGS. 12-14.

Figure 15:
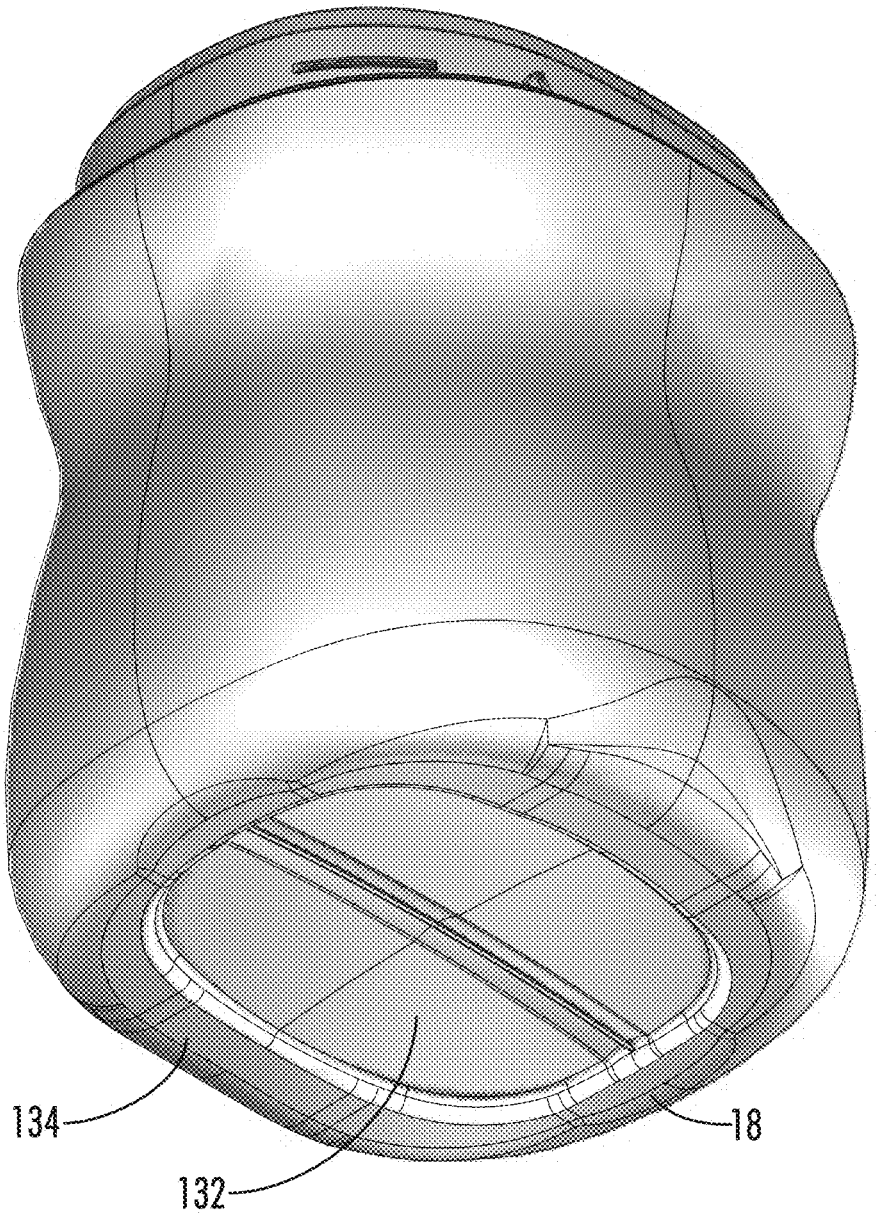
FIG. 15 displays the base of the tub.
Figure 16:
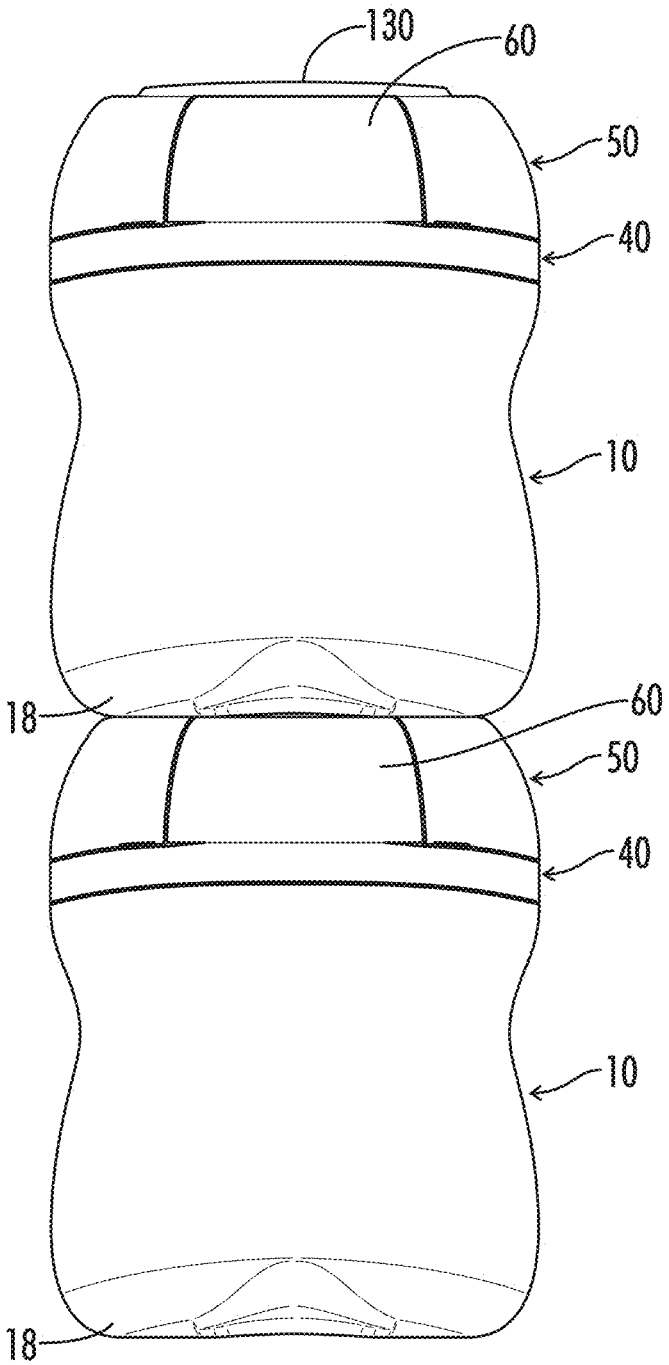
FIG. 16 shows multiple tubs vertically stacked.

Additionally, as shown in FIG. 15, the base 18 of the tub 10 may comprise a recessed center portion 132 and an outer perimeter 134. The raised center portion 130 of the lid 50 and the recessed center portion 132 of the base 18 are designed to be complementary in overall shape and size. For example, the raised center portion 130 of the lid may generally have an ellipsoidal or oval shape having a certain width, length and height that is complementary to the width, length and height of the recessed center portion 132 of the base 18. Accordingly, the raised center portion 130 of the lid 50 may be placed inside the recessed center portion 132 of the base 18, thereby allowing one container to be vertically stacked on top of another container, as shown in FIG. 16.

The raised center portion 130 of the lid 50 and the corresponding recessed center portion 132 of the base 18 may comprise a variety of shapes including but not limited to rectangular shapes, circular shapes, or ellipsoidal shapes. The height of the raised center portion 130 of the lid 50, in some embodiments, is generally the same height as the recessed center portion 132 of the base 18 thereby allowing the outer perimeter 134 of the base to securely rest on the perimeter of the outer top surface 52 of the lid 50 when one container is stacked on top of another container. See FIG. 16.

Figure 17:
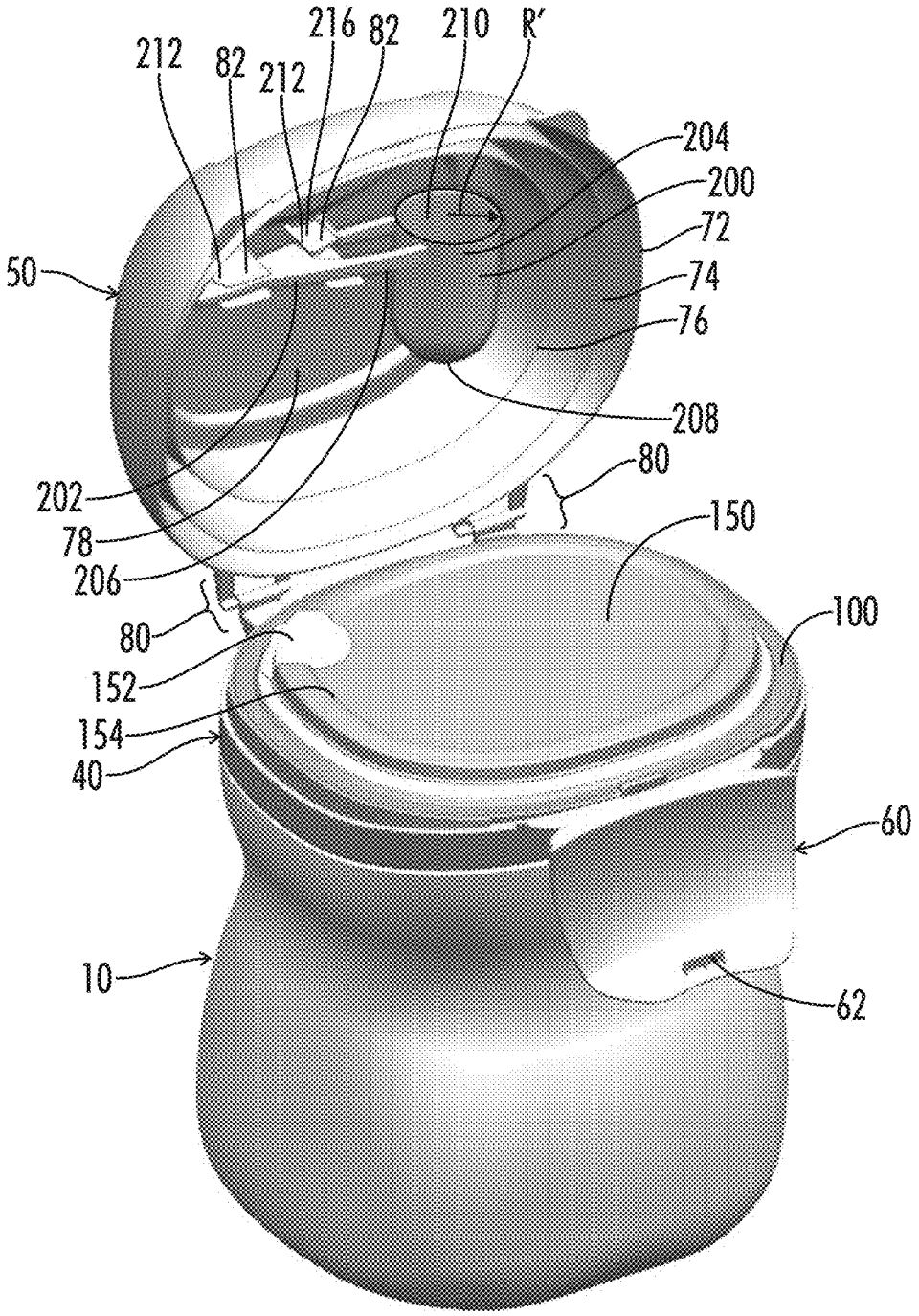
FIG. 17 displays a view of the container having the sealable membrane over the opening of the container and the lid in an open position on the tub.

The container of the present disclosure may also comprise a sealable membrane 150. The sealable membrane allows for vacuum packaging of the contents in tub 10 and provides an anti-tamper inner liner. Referring to FIG. 17, in some embodiments, the sealable membrane 150 is placed over the opening 20 of the tub 10. The sealable membrane 150 may be sealed to the opening flange 30 of the tub 10. In some embodiments, the sealable membrane 150 is sealed and/or bonded around the entire perimeter of the tub 10 with a suitable adhesive. The adhesive used to seal the sealable membrane 150 to the tub 10 may be any adhesive known and/or used in the art. In some embodiments, the sealable membrane 150 may be bonded to the tub using heat.

One skilled in the art of food packaging will be familiar with such sealable membranes. Specifically, adhesive or heat may be used to attach the sealable membrane 150 formed of food grade polyvinyl chloride, polystyrene, foil, or other suitable material to the opening flange 30 to form an airtight seal. Since the sealable membrane 150 is secured to the opening flange 30 via adhesive and/or bonded via a mechanical weld, removal of lid 50 will not disturb the sealable membrane 150 unless the sealable membrane 150 is cut or removed.

As can be seen in FIG. 17, the sealable membrane 150 may comprise a tab 152. Once the lid 50 is in an open position, the tab 152 may be gripped by the user such that the user can remove the sealable membrane 150 from the opening flange 30 of the tub 10. Accordingly, the tab 152 of the sealable membrane 150 extends laterally away from the opening flange 30 of the tub 10. In some embodiments, the tab 152 is generally parallel to the outer perimeter of the neck 26 of the tub 10. Still in other embodiments, the tab 152 may be folded back and lays on the surface of the sealable membrane 150 that seals the opening 20 of the tub 10. See FIG. 17.

In some embodiments the tab 152 is positioned on the corner of the tub. Placing the tab 152 in this position focuses and directs the initial peel force, which facilitates ease of removing the sealable membrane 150 from the tub 10. Thus, placing the tab 152 generally in a location that corresponds to the corner of the tub 10, allows for the sealable membrane 150 to be completely removed. Accordingly, the user does not have to spend additional time removing pieces of the sealable membrane 150 or potentially contaminating or soiling the product of the tub 10 when removing the sealable membrane 150.

When the lid 50 is in a closed position, the inner sealing wall 76 of the lid 50 may rest on the surface of the sealable membrane 150 along the opening flange 30 of the tub 10. However, in some embodiments, the tab 152 of the sealable membrane 150 is positioned such that when the lid 50 is closed the sealable membrane 150 is not pinched between the second lid sealing wall 74 and the collar 40 or the second lid sealing wall 74 and the gasket 100. In this manner the integrity of the tab 152 of the sealable membrane 150 is maintained. For example, if the sealable membrane 150 is crushed or depressed by the second lid sealing wall 74 of the lid 50 when the lid 50 is in closed position, then sealable membrane 150, especially the tab 152 portion, may crumple, rip and/or tear. If damage occurs to the tab 152 of the sealable membrane 150, then the user may have difficulty removing the sealable membrane 150 from the tub 10. Accordingly, in some embodiments, the tab 152 is designed having a shape and length such that it will not be caught between the second lid sealing wall 74 and the collar 40 and/or gasket 100.

In some embodiments, the sealable membrane 150 may comprise a utensil accommodating recess 154 that extends into the opening 20 of the tub 10 when the sealable membrane 150 is secured to the tub 10. For example, in some embodiments the utensil accommodating recess 154 extends into the interior space 22 of the tub 10 below the opening flange 30 of the tub 10. See FIGS. 14-17. In this manner, the accommodation recess 154 ensures that the sealable membrane 150 will not be pierced, torn or damaged in any way when the scoop 200 is secured in the scoop element 82 located on the inner top surface 78 of the lid 50.

Further, as shown in FIG. 17, in some embodiments, the container may comprise a scoop 200. Scoop 200 may be a scoop molded from a suitable plastic material, which may be blow molded, by extrusion or injection. Suitable plastics for forming the scoop 200 include, but are not limited to, various food grade polymers such as polystyrene, polystyrene-acrylonitile, acrylonitile-butadiene-styrene, styrene-maleicanhydride, polycarbonate, polyethylene terephthalate, polyvinylcyclohexane, and blends thereof.

In some embodiments the scoop 200 has a generally flat handle 202 attached to or integrally formed with a scooping mechanism 204 having a radius R'. In some embodiments, the scooping mechanism 204 is closed at one end 208 and open at a second end 210. In some embodiments the scooping mechanism comprises a cylindrical bowl. The bowl 204 may be formed in many other shapes including, but not limited to square, rectangular, oval, etc.

In some embodiments the scoop 200 is initially covered with a shrinkable film. Accordingly, providing the scoop 200 that is initially covered with a shrinkable film ensures that the scoop remains hygienic until the container is opened by the user.

The scoop 200 may be releasably secured to the lid 50 of the tub 10 by a scoop attachment element 82 located on the inner top surface 78 of the lid 50, as shown in FIG. 17. The scoop attachment element 82 may include multiple flexible tabs 212 arranged to releasably secure the scoop 200 to the inner top surface 78 of the lid 50. The flexible tabs 212 may be centrally located on the inner top surface 78 of the lid within the raised center portion 130.

Consequently, due to the scoop attachment element 82 the scoop 200 does not become buried in the granulated material located in the tub 10 and thereby eliminates the need for the user to dig through the contents in search of the scoop 200. This is especially important when the container's contents are for human consumption and contact with the hands is undesirable.

Figure 18:
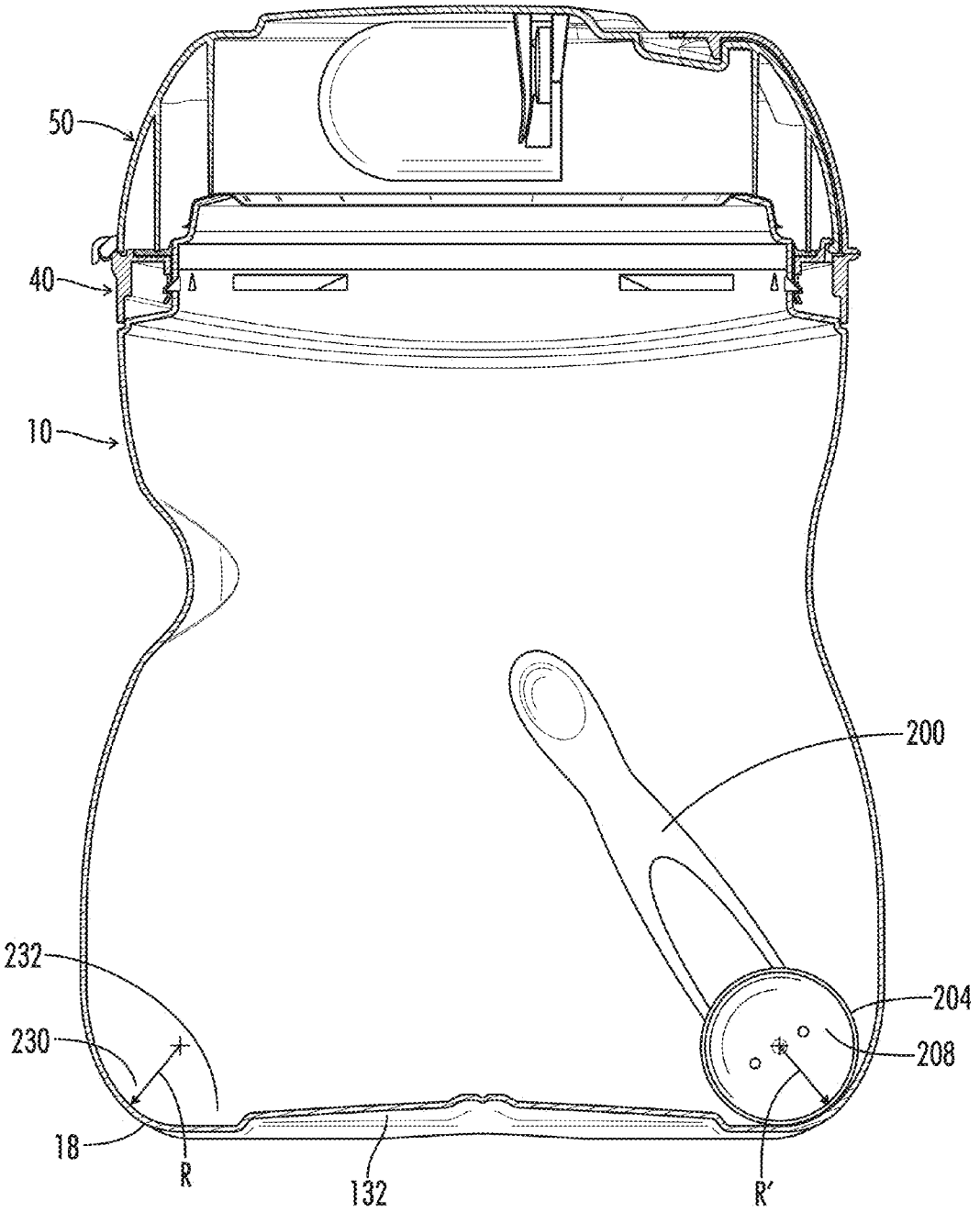
FIG. 18 is a cross section view of the container illustrating the circumferential channel located in the base of the container.

In addition to allowing containers to be stacked, the recessed center portion 132 of the base 18 serves a second purpose. Referring now to FIG. 18, in some embodiments, the recessed center portion 132 of the base 18 forms a circumferential channel 230 at the bottom of the tub 10. Generally, this channel 230 is formed between the area where the front wall 12, rear wall 14, first side wall **16*a* and second side wall 16*b* meet the base and the recessed center portion 132 of the base 18. The channel 230 is sized and shaped to receive cylindrical bowl 204 of scoop 200. The channel 230 may further include a radius R. In particular, the radius R' of cylindrical bowl 204 is approximately equal to or smaller than the radius of curvature R of the inside surface of the circumferential channel 230**.

The recessed center portion 132 of the base 18 and the wall of the tub 10 causes the granulated contents to gravitate into the channel 230 as the product is being used up. Therefore, the bowl 204 fits into the channel 230 and allows the user to scoop out substantially all the granulated contents in the container with little effort (such a channel/bowl arrangement would also allow the container to be utilized for liquid containment and dispensing if desired.). No matter what shape the channel 230 is, the bowl 204 should be sized and shaped to be received in channel 230. For example, a square-shaped channel would require a bowl that would fit in the channel. In particular, the bowl 204 should be shaped to facilitate scooping the contents of the tub 10 out of channel 230 and, therefore, is most often the same shape as the channel 230.

All references cited in this specification, including without limitation, all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinence of the cited references.

Although embodiments of the disclosure have been described using specific terms, devices, and methods, such description is for illustrative purposes only. The words used are words of description rather than of limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. Therefore, the spirit and scope of the appended claims should not be limited to the description of the versions contained therein.

What is claimed is:

1. A container comprising:

a tub having an opening flange defining the opening of the tub, at least one collar mating protrusion extending from and located about the upper portion of the tub, and an anti-rotation element;

a collar having at least one aperture designed to engage the at least one protrusion of the tub thereby securing the collar to the tub;

a latch hingedly connected to the collar having a lid engaging flange; and a lid hingedly attached to the collar having a latch engagement portion comprising an engagement recess, wherein the lid engaging flange of the latch securely engages the engagement recess of the lid when the container is closed;

wherein the collar comprises an outer sealing wall having one end in contact with the tub to create a sealing area C2 between the collar and the tub; and wherein the lid further comprises an outer sealing wall, a second lid sealing wall and an inner sealing wall, wherein one end of the outer sealing wall engages the collar thereby creating a seal C3 between the lid and collar, one end of the second lid sealing wall engages at least one surface of the gasket thereby creating a seal C4 between the lid and gasket, and at least one end of the inner sealing wall engages the opening flange of the tub thereby creating a seal C5 between the lid and tub.

2. The container of claim 1, wherein the tub comprises a plurality of collar mating protrusions and the collar comprises a plurality of apertures.

3. The container of claim 1, wherein the at least one protrusion further comprises a collar mating surface and the at least one aperture of the collar further comprises a tub mating surface such that the engagement of the collar mating surface to the tub mating surface securely attaches the collar to the tub.

4. The container of claim 1, further comprising a gasket.

5. The container of claim 1, further comprising a sealable membrane.

6. The container of claim 5, wherein the sealable membrane further comprises a tab to facilitate removal of the sealable membrane from the container.

7. The container of claim 1, further comprising a scoop.

8. A container comprising:

a tub having an opening flange defining the opening of the tub, at least one collar mating protrusion located in the upper portion of the tub, and a base having a recessed center portion;

a collar having at least one aperture designed to engage the at least one protrusion of the tub thereby securing the collar to the tub;

a lid hingedly attached to the collar having a top surface and an outer sealing wall; and a latch attached to the collar designed to sealing engage the lid;

wherein the lid further comprises a raised center portion complimentary to the recessed center portion of the base, such that multiple containers may be stacked on top of one another;

wherein the collar comprises an outer sealing wall having one end in contact with the tub to create a sealing area C2 between the collar and the tub; and wherein the lid further comprises an outer sealing wall, a second lid sealing wall and an inner sealing wall, wherein one end of the outer sealing wall engages the collar thereby creating a seal C3 between the lid and collar, one end of the second lid sealing wall engages at least one surface of the gasket thereby creating a seal C4 between the lid and gasket, and at least one end of the inner sealing wall engages the opening flange of the tub thereby creating a seal C5 between the lid and tub.

9. The container of claim 8, wherein the lid is hingedly attached to the collar and further comprises a latch that is integrally molded to the collar.

10. The container of claim 8, wherein the lid further comprises a latch engagement recess portion comprising a first recess located on the top surface of the lid and second recess located on the outer sealing wall of the lid, wherein the first and second recess are designed to sealingly accommodate the latch.

11. The container of claim 10, wherein the latch engagement recess of the lid further comprises an engagement recess and the latch comprises a lid engaging flange that securely engages the engagement recess of the lid and makes an audible sealing noise when the latch is secured to the lid.

12. The container of claim 8, wherein the collar further comprises a gasket.

13. The container of claim 8, wherein the container further comprises a sealable membrane releaseably adhered to the opening flange of the tub, wherein the sealable membrane further comprises a tab extending beyond opening flange of the tub such that the tab can facilitate removal of the sealable membrane from the container.

14. The container of claim 13, wherein the tab is designed such that it is not depressed between sealing region C4.

15. A container comprising:

a tub having an opening flange defining the opening of the tub, at least one collar mating protrusion located in the upper portion of the tub, and a base having a recessed center portion;

a collar having at least one aperture designed to engage the at least one protrusion of the tub thereby securing the collar to the tub;

a lid hingedly attached to the collar having a top surface and an outer sealing wall, wherein the top surface comprises a raised center portion; and a latch attached to the collar designed to sealing engage the lid; wherein the collar comprises an outer sealing wall having one end in contact with the tub to create a sealing area C2 between the collar and the tub; and wherein the lid further comprises an outer sealing wall, a second lid sealing wall and an inner sealing wall, wherein one end of the outer sealing wall engages the collar thereby creating a seal C3 between the lid and collar, one end of the second lid sealing wall engages at least one surface of the gasket thereby creating a seal C4 between the lid and gasket, and at least one end of the inner sealing wall engages the opening flange of the tub thereby creating a seal C5 between the lid and tub; and further wherein the container comprises a scoop comprising a handle and a bowl, wherein the bowl has a radius R'.

16. The container of claim 15, wherein the lid further comprises a utensil attachment element wherein the utensil attachment element comprises at least one flexible tab extending from the raised center of the lid towards the interior of the container.

17. The container of claim 15, wherein the base of the container comprises a circumferential channel having a radius R and wherein the radius R' of the bowl is equal to or smaller than the radius R' of the circumferential channel such that the bowl of the scoop fits within the circumferential channel.

* * * * *